US005832345A

United States Patent [19]

Damji et al.

[11] Patent Number: 5,832,345

[45] Date of Patent: Nov. 3, 1998

[54] PROCESS CARTRIDGE HAVING A DRIVE ASSEMBLY RESULTANT FORCE COUNTER ACTING MEMBER

[75] Inventors: Dhirendra C. Damji, Webster; Ajay Kumar, Fairport, both of N.Y.

[73] Assignee: Xerox Corporation, Stamford, Conn.

[21] Appl. No.: 970,324

[22] Filed: Nov. 14, 1997

[51] Int. Cl.[6] ..... G03G 15/00; G03G 21/16

[52] U.S. Cl. ..... 399/167; 399/111

[58] Field of Search ..... 399/167, 111, 399/116, 156

[56] References Cited

U.S. PATENT DOCUMENTS

| | | | |
|---|---|---|---|
| 5,398,097 | 3/1995 | Satoh et al. | 399/111 |
| 5,420,664 | 5/1995 | Miwa et al. | 399/167 |
| 5,432,590 | 7/1995 | Nomura et al. | 399/167 |
| 5,471,286 | 11/1995 | Tanaka | 399/167 |
| 5,528,348 | 6/1996 | Miwa et al. | 399/167 |
| 5,602,623 | 2/1997 | Nishibata et al. | 399/167 X |
| 5,631,726 | 5/1997 | Sawada | 399/111 |

*Primary Examiner*—S. Lee
*Attorney, Agent, or Firm*—Tallam I. Nguti

[57] ABSTRACT

An electrostatographic process cartridge detachably mountable into a cavity defined by mated modules forming parts of an electrostatographic reproduction machine. The process cartridge includes an elongate plastic housing having a first side and a second side, as well as an inner surface defining a process chamber. It also includes a rotatable photoreceptive member mounted within the process chamber and to the housing and having an image bearing surface for holding a formed toner image; a rotatable developer member mounted to the housing, and forming a critical development gap with the photoreceptive member within the process chamber for enabling jumping toner image development on the image bearing surface; a drive assembly mounted at the second side of the housing for coupling to the photoreceptive member; and a gear train mounted at the second side of the housing, and coupled to the drive assembly and the developer member for transmitting drive to the developer member. The gear-train as mounted including a developer member gear, and having a resultant drive force pushing the developer member gear away from the photoreceptive member, thus tending to widen the critical development gap. Importantly, the process cartridge includes a resultant force counter-acting member mounted to the second side of the housing for absorbing the drive resultant force. The resultant force counter-acting member includes a wall and a retaining aperture for precisely retaining the developer member in a predetermined aligned position so as to maintain the critical development gap, and thereby ensure uniform quality toner image development.

7 Claims, 9 Drawing Sheets

PROCESS CARTRIDGE HAVING A DRIVE ASSEMBLY RESULTANT FORCE COUNTER ACTING MEMBER

RELATED CASE

Cross reference is made to the following applications filed concurrently herewith: Ser. No. 08/971,075, entitled "Pin Charge Corotron With Optimum Dimensions For Minimum Ozone Production" by Dhirendra C. Damji et al.; Ser. No. 08/970,719, entitled "Development Bias Connector With Integral Bearing Support" by Dhirendra C. Damji et al.; Ser. No. 08/970,842, entitled "Charging Device Module For Use With Print Cartridge" by Ajay Kumar et al.; Ser. No. 08/971,098, entitled "Charging Device Having An Electrode With Integral Electrical Connector" by Ajay Kumar et al.; Ser. No. 08/971,015, entitled "Charging Device Having A Shield With Integral Electrical Connector" by Ajay Kumar et al.; Ser. No. 08/971,690, entitled "Variable Size, Replaceable Toner Sump Pans For Print Cartridges" by Dhirendra C. Damji et al.; Ser. No. 08/970,313, entitled "Molded Quick Change Photoreceptor Support" by Ajay Kumar et al.; Ser. No. 08/971,010, entitled "Printing Cartridge With Planar Drive Train" by Ajay Kumar et al.; and Ser. No. 08/971,691, entitled "Printing Cartridge With Molded Cantilever Developer Roller Spacing Spring" by Ajay Kumar et al.

Additionally, cross reference is made to the following applications filed concurrently herewith: Ser. No. 08/970,322, entitled "Process Cartridge Including Process Components Having Critical Image Quality And Life-Extending Process Path Acting Regions" by Dhirendra C. Damji et al.; Ser. No. 08/970,834, entitled "Process Cartridge Including A Handle Defining Part Of A Machine Paper Path" by Dhirendra C. Damji et al; Ser. No. 08/970,321, entitled "Electrostatographic Process Cartridge Having A Non-Metallic Photoreceptor Grounding Pin" by Daniel A. Chiesa et al.; Ser. No. 08/970,318, entitled "Limited Life Electrostatographic Process Cartridge Having a Waste Toner Electro-Sump Subassembly" by Daniel A. Chiesa et al.; Ser. No. 08/970,324, entitled "Process Cartridge Having A Drive Assembly Resultant Force Counter Acting Member" by Dhirendra C. Damji et al.; Ser. No. 08/970,320, entitled "Process Cartridge Including A Banding Defect Preventing Waste Toner Moving Auger" by Dhirendra C. Damji et al.; Ser. No. 08/970,323, entitled "Process Cartridge Including A Developer Housing Defining Part Of A Machining Paper Path" by Dhirendra C. Damji et al.; and Ser. No. 08/970,847, entitled "All-In-One Process Cartridge Including A Photoreceptor And Process Components Having Relative Critical, Image Quality Acting Regions" by Ajay Kumar et al.

BACKGROUND

This invention relates to electrostatographic reproduction machines, and more particularly to an economical and capacity-extendible all-in-one process cartridge for easy adaptive use in a family of compact electrostatographic reproduction machines having different volume capacities and consumable life cycles. Specifically, the invention relates to such a process cartridge having a drive assembly resultant force counter-acting member, for ensuring high quality uniform toner image development.

Generally, the process of electrostatographic reproduction, as practiced in electrostatographic reproduction machines, includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred at a transfer station onto a copy sheet fed to such transfer station, and on which the toner particles image is then heated and permanently fused so as to form a "hardcopy" of the original image.

It is well known to provide a number of the elements and components, of an electrostatographic reproduction machine, in the form of a customer or user replaceable unit (CRU). Typically such units are each formed as a cartridge that can be inserted or removed from the machine frame by a customer or user. Reproduction machines such as copiers and printers ordinarily include consumable materials such as toner, volume limiting components such as a waste toner container, and life cycle limiting components such as a photoreceptor and a cleaning device. Because these elements of the copying machine or printer must be replaced frequently, they are more likely to be incorporated into a replaceable cartridge as above.

There are therefore various types and sizes of cartridges, varying from single machine element cartridges such as a toner cartridge, to all-in-one electrostatographic toner image forming and transfer process cartridges. The design, particularly of an all-in-one cartridge can be very costly and complicated by a need to optimize the life cycles of different elements, as well as to integrate all the included elements, while not undermining the image quality. This is particularly true for all-in-one process cartridges to be used in a family of compact electrostatographic reproduction machines having different volume capacities and elements having different life cycles.

There is therefore a need for a quality image producing, economical and capacity-extendible all-in-one process cartridge that is easily adapted for use in various machines in a family of compact electrostatographic reproduction machines having different volume capacities and elements with different life cycles.

SUMMARY OF THE INVENTION

In accordance with the present invention, there has been provided an electrostatographic process cartridge detachably mountable into a cavity defined by mated modules forming parts of an electrostatographic reproduction machine. The process cartridge includes an elongate plastic housing having a first side and a second side, as well as an inner surface defining a process chamber. It also includes a rotatable photoreceptive member mounted within the process chamber and to the housing and having an image bearing surface for holding a formed toner image; a rotatable developer member mounted to the housing, and forming a critical development gap with the photoreceptive member within the process chamber for a enabling jumping toner image development on the image bearing surface; a drive assembly mounted at the second side of the housing for coupling to the photoreceptive member; and a gear train mounted at the second side of the housing, and coupled to the drive assembly and the developer member for transmitting drive to the developer member. The gear-train as mounted including a developer member gear, and having a resultant drive force pushing the developer member gear away from the photoreceptive member, thus tending to widen the critical development gap. Importantly, the process cartridge includes a resultant force counter-acting member mounted to the second side of the housing for absorbing the drive resultant force. The resultant force counter-acting member includes a wall and a retaining aperture for precisely retaining the developer member in a predetermined aligned position so as to maintain the critical development gap, and thereby ensure uniform quality toner image development.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
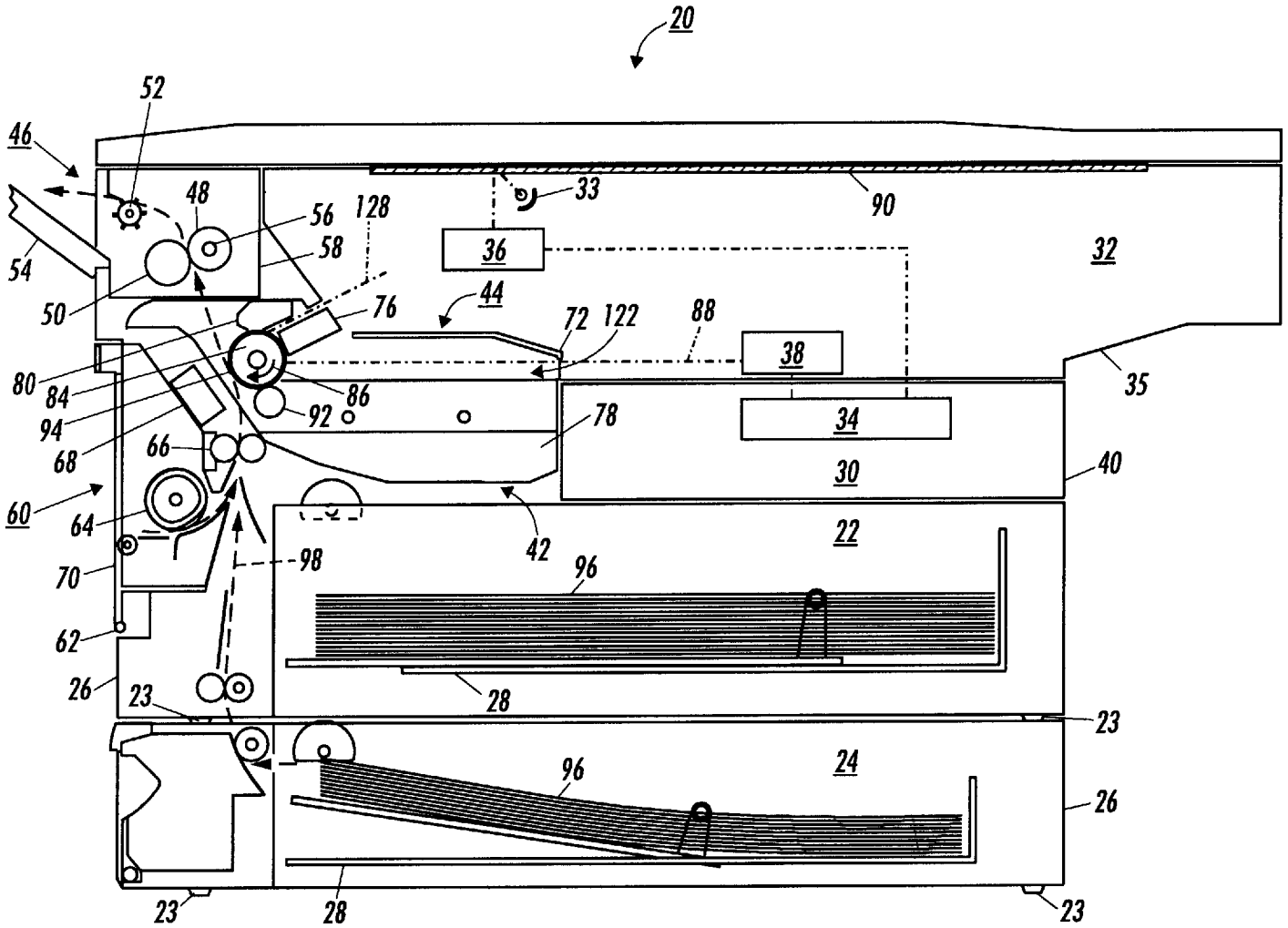
FIG. 1 is a front vertical illustration of an exemplary compact electrostatographic reproduction machine comprising separately framed mutually aligning modules in accordance with the present invention.

Referring now to FIG. 1, there is illustrated a frameless exemplary compact electrostatographic reproduction machine 20 comprising separately framed mutually aligning modules according to the present invention. The compact machine 20 is frameless, meaning that it does not have a separate machine frame to which electrostatographic process subsystems are assembled, aligned to the frame, and then aligned relative to one another as is typically the case in conventional machines. Instead, the architecture of the compact machine 20 is comprised of a number of individually framed, and mutually aligning machine modules that variously include pre-aligned electrostatographic active process subsystems.

As shown, the frameless machine 20 comprises at least a framed copy sheet input module (CIM) 22. Preferably, the machine 20 comprises a pair of copy sheet input modules, a main or primary module the CIM 22, and an auxiliary module the (ACIM) 24, each of which has a set of legs 23 that can support the machine 20 on a surface, therefore suitably enabling each CIM 22, 24 to form a base of the machine 20. As also shown, each copy sheet input module (CIM, ACIM) includes a module frame 26 and a copy sheet stacking and lifting cassette tray assembly 28 that is slidably movable in and out relative to the module frame 26. When as preferred here, the machine 20 includes two copy sheet input modules, the very base module is considered the auxiliary module (the ACIM), and the top module which mounts and mutually aligns against the base module is considered the primary module (the CIM).

The machine 20 next comprises a framed electronic control and power supply (ECS/PS) module 30, that as shown mounts onto, and is mutually aligned against the CIM 22 (which preferably is the top or only copy sheet input module). A framed latent image forming imager module 32 then mounts over and is mutually aligned against the ECS/PS module. The ECS/PS module 30 includes all controls and power supplies (not shown) for all the modules and processes of the machine 20. It also includes an image processing pipeline unit (IPP) 34 for managing and processing raw digitized images from a Raster Input Scanner (RIS) 36, and generating processed digitized images for a Raster Output Scanner (ROS) 38. As shown, the RIS 36, the ROS 38, and a light source 33, framed separately in an imager module frame 35, comprise the imager module 32. The ECS/PS module 30 also includes harnessless interconnect boards and inter-module connectors (not shown), that provide all power and logic paths to the rest of the machine modules. An interconnect board (PWB) (not shown) connects the ECS controller and power supply boards (not shown) to the inter-module connectors, as well as locates all of the connectors to the other modules in such a manner that their mating connectors would automatically plug into the ECS/PS module during the final assembly of the machine 20. Importantly, the ECS/PS module 30 includes a module frame 40 to which the active components of the module as above are mounted, and which forms a covered portion of the machine 20, as well as locates, mutually aligns, and mounts to adjacent framed modules, such as the CIM 22 and the imager module 32.

The framed copy sheet input modules 22, 24, the ECS/PS module 30, and the imager module 32, as mounted above, define a cavity 42. The machine 20 importantly includes a customer replaceable, all-in-one CRU or process cartridge module 44 that is insertably and removably mounted within the cavity 42, and in which it is mutually aligned with, and operatively connected to, the framed CIM, ECS/PS and imager modules 22, 30, 32.

As further shown, the machine 20 includes a framed fuser module 46, that is mounted above the process cartridge module 44, as well as adjacent an end of the imager module 32. The fuser module 46 comprises a pair of fuser rolls 48, 50, and at least an exit roll 52 for moving an image carrying sheet through, and out of, the fuser module 46 into an output or exit tray 54. The fuser module also includes a heater lamp 56, temperature sensing means (not shown), paper path handling baffles(not shown), and a module frame 58 to which the active components of the module, as above, are mounted, and which forms a covered portion of the machine 20, as well as locates, mutually aligns, and mounts to adjacent framed modules, such as the imager module 32 and the process cartridge module 44.

The machine then includes an active component framed door module 60 that is mounted pivotably at pivot point 62 to an end of the CIM 22. The door module 60 as mounted, is pivotable from a substantially closed vertical position into an open near-horizontal position in order to provide access to the process cartridge module 44, as well as for jam clearance of jammed sheets being fed from the CIM 22. The Door module 60 comprises active components including a bypass feeder assembly 64, sheet registration rolls 66, toner image transfer and detack devices 68, and the fused image output or exit tray 54. The door module 60 also includes drive coupling components and electrical connectors (not shown), and importantly, a module frame 70 to which the active components of the module as above are mounted, and which forms a covered portion of the machine 20, as well as, locates, mutually aligns, and mounts to adjacent framed modules, such as the CIM 22, the process cartridge module 44, and the fuser module 46.

More specifically, the machine 20 is a desktop digital copier, and each of the modules 22, 24, 30, 32, 44, 48, 60, is a high level assembly comprising a self-containing frame and active electrostatographic process components specified for sourcing, and enabled as a complete and shippable product. It is believed that some existing digital and light lens reproduction machines may contain selective electrostatographic modules that are partitioned for mounting to a machine frame, and in such a manner that they could be designed and manufactured by a supplier. However, there are no known such machines that have no separate machine frame but are comprised of framed modules that are each designed and supplied as self-standing, specable (i.e. separately specified with interface inputs and outputs), testable, and shippable module units, and that are specifically crafted and partitioned for enabling all of the critical electrostatographic functions upon a simple assembly. A unique advantage of the machine 20 of the present invention as such is that its self-standing, specable, testable, and shippable module units specifically allow for high level sourcing to a small set of module-specific skilled production suppliers. Such high level sourcing greatly optimizes the quality, the total cost, and the time of delivering of the final product, the machine 20.

Referring now to FIGS. 1–6, the CRU or process cartridge module 44 generally comprises a module housing subassembly 72, a photoreceptor subassembly 74, a charging subassembly 76, a developer subassembly 78 including a source of fresh developer material, a cleaning subassembly 80 for removing residual toner as waste toner from a surface of the photoreceptor, and a waste toner sump subassembly 82 for storing waste toner. The module housing subassembly 72 of the CRU or process cartridge module 44 importantly provides and includes supporting, locating and aligning structures, as well as driving components for the process cartridge module 44.

Still referring to FIG. 1, operation of an imaging cycle of the machine 20 using the all-in-one process cartridge module 44 generally, can be briefly described as follows. Initially, a photoreceptor or photoreceptive member having a photoconductive image bearing surface for carrying a formed toner image, (shown in the form of a photoconductive drum 84 of the customer replaceable unit (CRU) or process cartridge module 44 and rotating in the direction of the arrow 86), is charged by the charging subassembly 76. The charged portion of the drum is then transported to an imaging/exposing light 88 from the ROS 38 which forms a latent image on the drum 84, corresponding to an image of a document positioned on a platen 90, via the imager module 32. It will also be understood that the imager module 32 can easily be changed from a digital scanning module to a light lens imaging module.

The portion of the drum 84 bearing a latent image is then rotated to the developer subassembly 78 where the latent image is developed with developer material such as with charged single component magnetic toner using a magnetic developer roller 92 of the process cartridge module 44. The developed image on the drum 84 is then rotated to a near vertical transfer point 94 where the toner image is transferred to a copy sheet substrate 96 fed from the CIM 22 or ACIM 24 along a copy sheet or substrate path 98. In this case, the detack device 68 of the door module 60 is provided for charging the back of the copy sheet substrate (not shown) at the transfer point 94, in order to attract the charged toner image from the photoconductive drum 84 onto the copy sheet substrate.

The copy sheet substrate with the transferred toner image thereon, is then directed to the fuser module 46, where the heated fuser roll 48 and pressure roll 50 rotatably cooperate to heat, fuse and fix the toner image onto the copy sheet substrate. The copy sheet substrate then, as is well known, may be selectively transported to the output tray 54 or to another post-fusing operation.

The portion of the drum 84 from which the developed toner image was transferred is then advanced to the cleaning subassembly 80 where residual toner and residual charge on the drum 84 are removed therefrom. The imaging cycle of the machine 20 using the drum 84 can then be repeated for forming and transferring another toner image as the cleaned portion again comes under the charging subassembly 76.

The detailed and specific advantageous aspects of the structure and operation of the all-in-one CRU or process cartridge module 44, will now be described with particular reference to FIGS. 1 to 6. As shown, the all-in-one CRU or process cartridge module 44, generally includes six subassemblies comprising the module housing subassembly 72 (FIG. 2); the cleaning subassembly 80; the photoreceptor subassembly 74; the charging subassembly 76; the developer subassembly 78 (FIG. 3); and the waste toner sump subassembly 82. Generally, the function of the all-in-one CRU or process cartridge module 44 in the machine 20 is to electrostatically form a latent image, develop such latent image into a toner image through toner development, and transfer the toner image unfused onto a printing medium, such as a sheet of paper. The CRU or process cartridge module is left-side accessible to an operator facing the CIM 22 by opening the door module 60 (FIG. 1). Once the door module is opened, an operator or customer can remove or insert the CRU or process cartridge module 44 with one hand.

Figure 2:
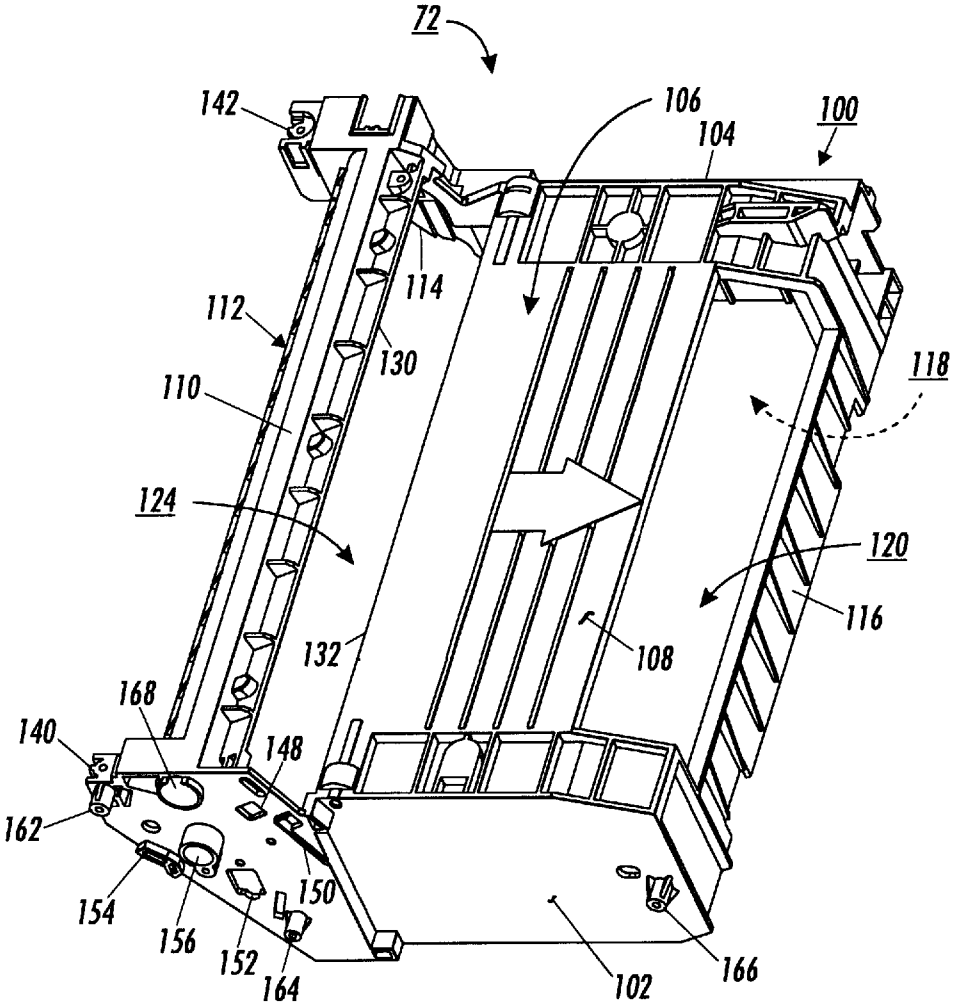
FIG. 2 is a top perspective view of the module housing of the CRU or process cartridge module of the machine of FIG. 1.
Figure 3:
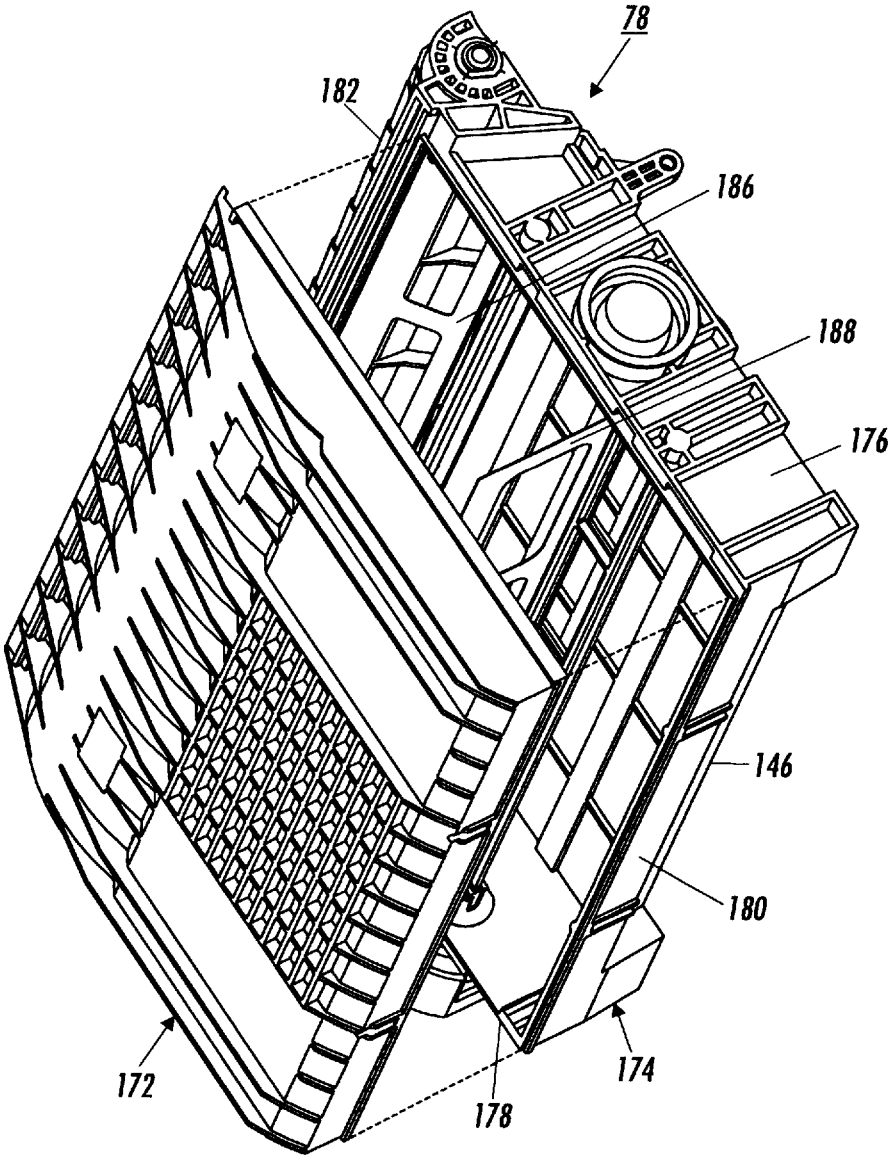
FIG. 3 is a bottom perspective view of the developer subassembly of the CRU or process cartridge module of the machine of FIG. 1 with the bottom of the developer housing unattached.

Referring now to FIGS. 1–6, the module housing subassembly 72 is illustrated (FIG. 2). As shown, it comprises a generally rectangular and inverted trough shaped module housing 100 made of a plastic material and having a first side wall 102, a second and opposite side wall 104, a top wall 106 including a substantially horizontal portion 108 and a nearly vertical portion 110 defining a raised rear end 112 (rear as considered relative to the process cartridge 44 being inserted into the cavity 42). There is no rear wall, thus resulting in an open rear end 114 for mounting the photoreceptor subassembly 74. The trough shaped module housing also includes a front end wall 116 that connects at an angle to the top wall 106. The trough shaped module housing 100 of course, has no bottom wall, and hence as inverted, it defines a trough region or process chamber 118 that is wide open for assembling the developer subassembly 78 (FIG. 3). The top wall 106 and the front end wall 116 each include a first cutout 120 formed through their adjoining corner for partially defining a first light path 122 (FIG. 1) for the exposure light 88 from the ROS 38 of the imager module 32. The top wall 106 also includes a second cutout 124 formed thereinto at the adjoining angle between the horizontal 108 and near vertical 110 portions thereof for mounting the charging subassembly 76 (FIG. 5), and for partially defining a second light path 126 (FIGS. 1 and 6) for an erase light 128 being focused into the photoreceptor area at the raised rear end 112 of the module housing 100.

Importantly, the module housing 100 includes two top wall cross-sectional surfaces 130, 132 defining the second cutout 124, and one 130, of these cross-sectional wall surfaces, has a desired angle 134 (relative to the photoreceptor surface) for mounting and setting a cleaning blade 138 (FIG. 6) of the cleaning subassembly 80. Attachment members 140, 142 are provided at the raised rear end 112 and extending from the first and second side walls 102, 104 respectively, for attaching a module handle 144 to the module housing 100.

As pointed out above, the module housing 100 is the main structure of the all-in-one CRU or process cartridge module 44, and importantly supports all other subassemblies (cleaning subassembly 80, charging subassembly 76, developer subassembly 78, and sump subassembly 82) of the all-in-one process cartridge module 44. As such, it is designed for withstanding stresses due to various dynamic forces of the subassemblies, for example, for providing a required re-action force to the developer subassembly 78. Because it is located just about 3 mm below the fuser module 46, it is therefore made of a plastic material suitable for withstanding relatively high heat generated from the fuser module. Mounts (not shown) to the developer subassembly within the trough portion of the module housing subassembly are located such that the top wall 106 of the module housing defines a desired spacing comprising the first light path 122 between it and the top 146 of the developer subassembly. Similarly, the raised rear end 112 of the top wall 106 of the module housing is also such as to define a desired spacing between the charging subassembly 76 and the photoreceptor or drum 84, when both are mounted to the raised rear end 112 of the module housing 100. Additionally, the module housing 100 provides rigidity and support to the entire process cartridge module 44, and upon assembly mutually self-aligns the CRU or process cartridge module 44 relative to abutting modules such as the CIM 22, and ECS/PS module 30.

Figure 6:
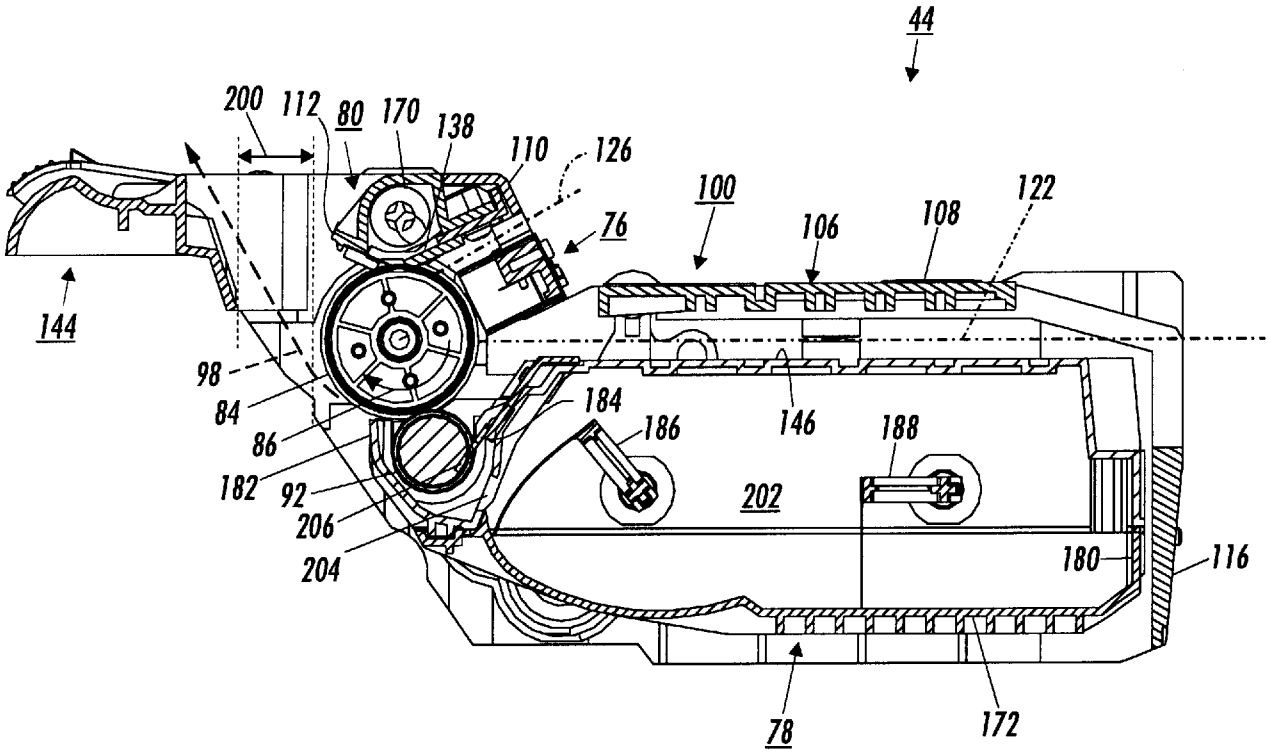
FIG. 6 is a vertical section (front-to-back) of the CRU or process cartridge module of the machine of FIG. 1.

Referring in particular to FIG. 2, the first side wall 102 includes electrical connectors 148, 150 for supplying power from the ECS/PS module 30 (FIG. 1) via the sump subassembly 82 to the charging subassembly 76. It also includes an electrical connector 152 for supplying an electrical bias to the developer subassembly 78, as well as an alignment member 154 for aligning the detack device 68 (FIG. 1) to the photoreceptor. As also shown, the first side wall 102 further includes an apertured retainer device 156 for receiving an electrical grounding pin 160 for the photoreceptor 84. Importantly, the first side wall 102 further includes mounting members 162, 164, 166 for mounting the sump subassembly 82 to the module housing 100, and an opening 168 for mounting an auger 170 of the cleaning subassembly 80 (FIG. 6). The opening 168 also passes waste toner received from the photoreceptor 84 in the raised rear end 112, into the sump assembly 82, when mounted as above.

Referring now to FIG. 3, the developer subassembly 78 of the process cartridge module 44 is illustrated with an expandable bottom member 172 unattached in order to reveal the inside of the developer subassembly. As shown, the developer subassembly 78 comprises a generally rectangular developer housing 174 having the bottom member 172, the top 146, a first side 176, a second and opposite side 178, a front end 180 (relative to cartridge insertion), and a rear end 182. The developer housing 174 is for containing developer material, such as, single component magnetic toner (not shown), and it additionally houses the magnetic developer roll 92 (FIG. 1), a development bias application device 184, and a pair of developer material or toner agitators 186, 188.

Figure 4:
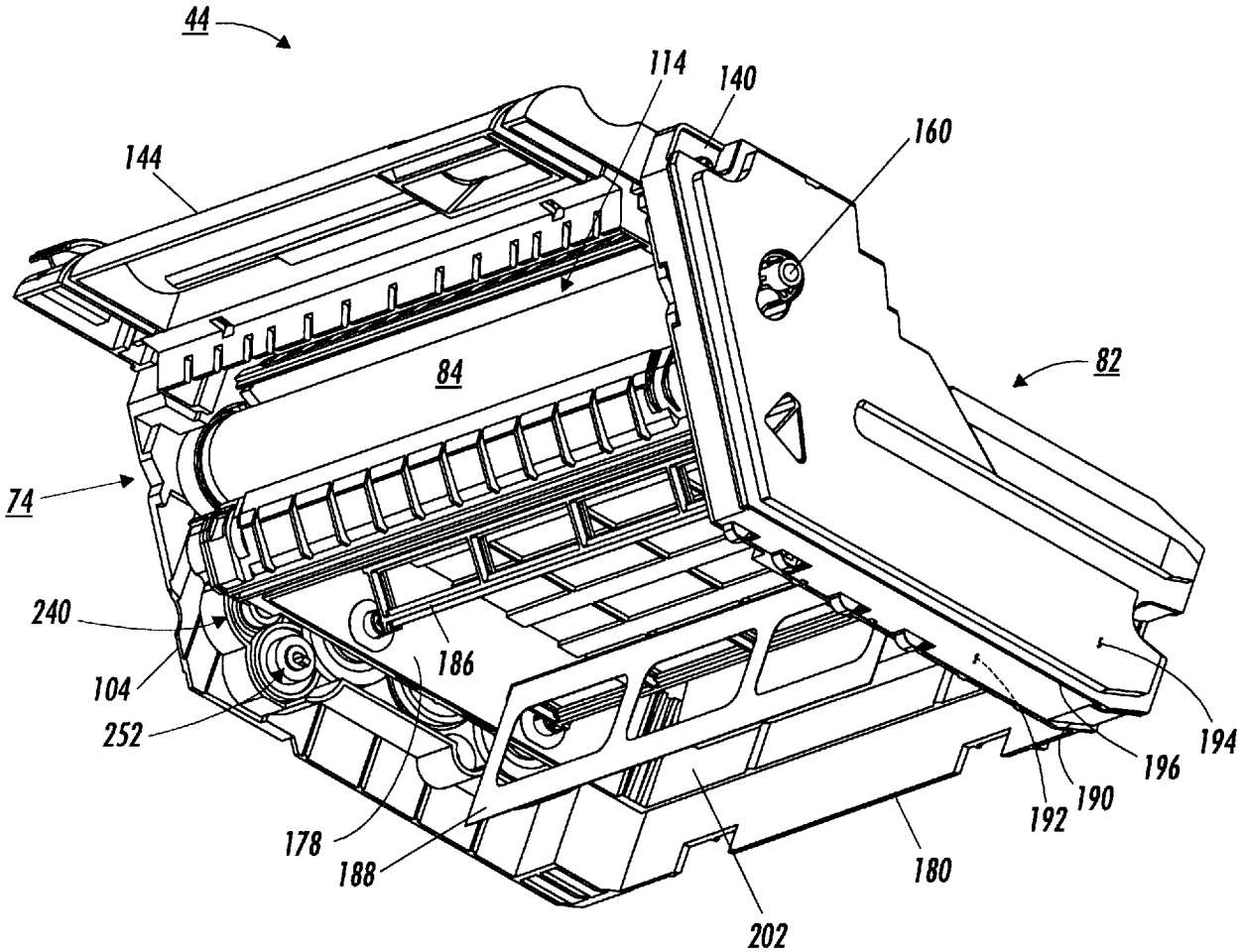
FIG. 4 is an open bottom perspective view of the CRU or process cartridge module of the machine of FIG. 1.

As shown in FIG. 4, the developer subassembly 78 is mounted to the module housing 100, and inside the trough region 118. With the bottom member 172 of the developer housing removed (for illustration purposes only), the agitators 186, 188 can clearly be seen. Also shown in FIG. 4 are the photoreceptor or drum 84 mounted within the raised rear end 112 of the module housing 100, as well as, the module handle 144 attached to the side walls 102, 104 at the raised rear end 112. The whole sump subassembly 82 is further shown with an outside surface 190 of its inside wall 192, mounted to the first side wall 102 of the module housing 100. The outside surface 194 of the outside wall 196 of the sump assembly is also clearly visible. The inside wall 192 and outside wall 196 partially define the sump cavity (not shown) for containing received waste toner, as above.

Figure 5:
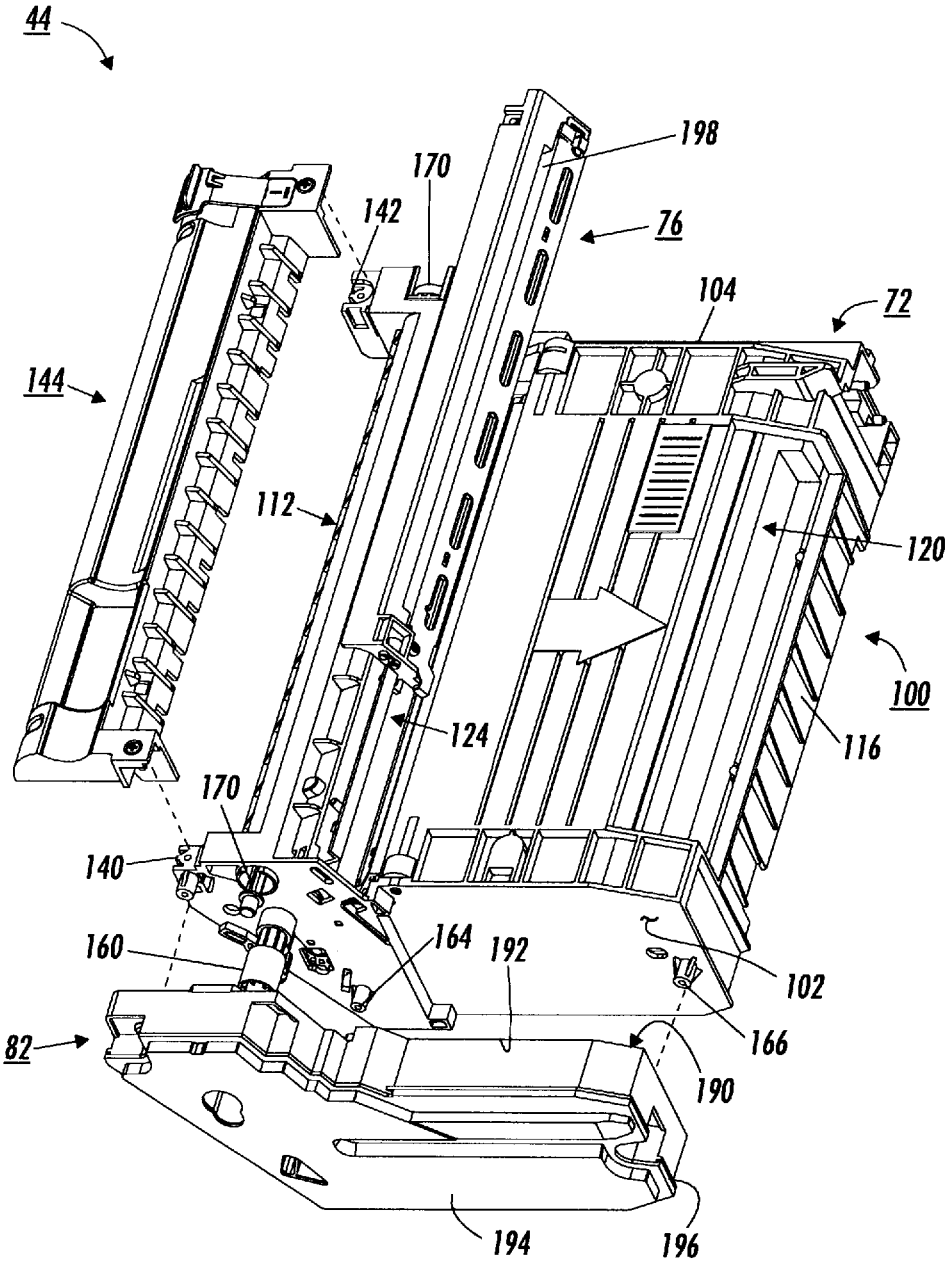
FIG. 5 is an exploded view of the various subassemblies of the CRU or process cartridge module of the machine of FIG. 1.

Referring now to FIG. 5, there is presented an exploded perspective view of the various subassemblies, as above, of the CRU or process cartridge module 44. As shown, the module handle 144 is attachable to mounting members 140, 142 at the raised rear end 112 of the module housing 100, and the sump subassembly 82 is mountable to the first side wall 102 of the cartridge housing. The developer subassembly 78 is mounted within the trough region 118 of the module housing 100, and is partially visible through the first cutout 120. Advantageously, the developer subassembly fits into the trough region 118 such that the top 146 (FIG. 3) of the developer subassembly and the inside of the top wall 106 of the module housing define the first light path 122 for the exposure light 88 from the ROS 38 (FIG. 1). As also shown, the charging subassembly 76 is mountable, at the second cutout 124, to the module housing 100, and includes a slit 198, through the charging subassembly, that defines part of the second light path 126 for the erase light 128 to pass to the photoreceptor 84.

Referring next to FIG. 6, a vertical (rear-to-back) section of the CRU or process cartridge module 44 as viewed along the plane 6-6 of FIG. 5 is illustrated. As shown, the developer subassembly 78 is mounted within the trough region 118 of the module housing subassembly 72 as defined in part by the front end wall 116, the second side wall 104, and the top wall 106 of the module housing subassembly. The module handle 144 as attached to mounting members 140, 142, (only one of which is visible), forms a portion of the sheet or paper path 98 of the machine 20 (FIG. 1) by being spaced a distance 200 from photoreceptor 84 in the raised rear end 112 of the module housing 100. The photoreceptor or drum 84 is mounted to the side walls 102, 104, (only one of which is visible), and as shown is located within the raised rear end 112 and is rotatable in the direction of the arrow 86. The charging subassembly 76 is mounted within the second cutout 124 in the top wall 106 and includes the slit 198 defining part of the second light path 126 for erase light 128 to pass to the photoreceptor 84. Upstream of the charging subassembly 76, the cleaning subassembly 80, including the cleaning blade 138 and the waste toner removing auger 170, is mounted within the raised rear end 112, and into cleaning contact with the photoreceptor 84. As further shown, the top wall 106 of the module housing 100 is spaced from the top 146 of the developer subassembly 78, thus defining the part of first light path 122 for the exposure light 88 from the ROS 38 (FIG. 1). The first light path 122 is located so as to be incident onto the photoreceptor at a point downstream of the charging subassembly 76.

The front 180, top 146, and bottom member 172 of the developer subassembly define a chamber 202, having an opening 204, for containing developer material (not shown). The first and second agitators 186, 188 are shown within the chamber 202 for mixing and moving developer material towards the opening 204. The developer material biasing device 184 and a charge trim and metering blade 206 are mounted at the opening 204. As also shown, the magnetic developer roll 92 is mounted at the opening 204 for receiving charged and metered developer material from such opening, and for transporting such developer material into a development relationship with the photoreceptor 84.

Figure 7:
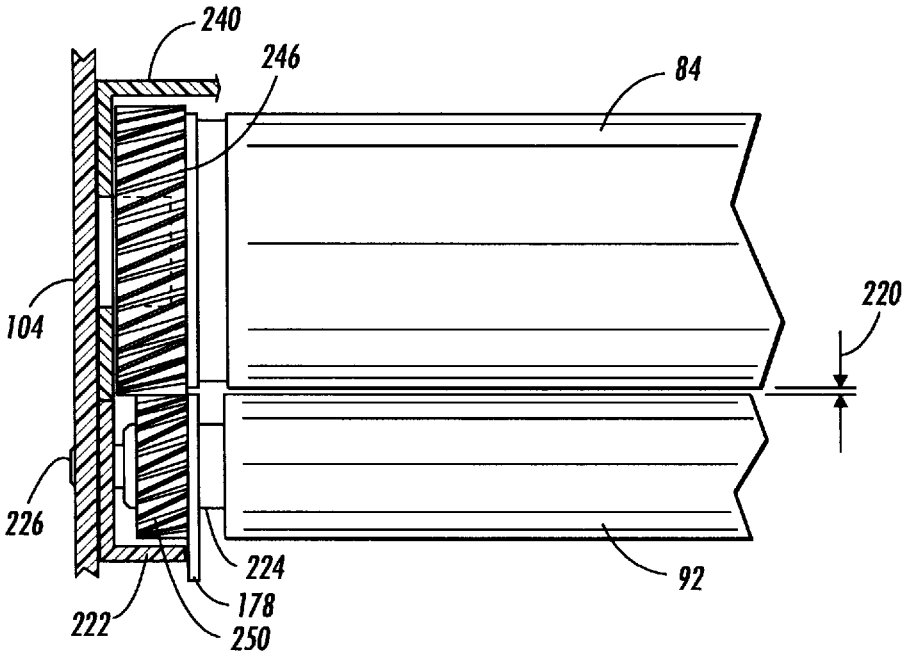
FIG. 7 is a partial elevational schematic of the photoreceptor and the developer roll showing a desired jumping development spacing therebetween.
Figure 8:
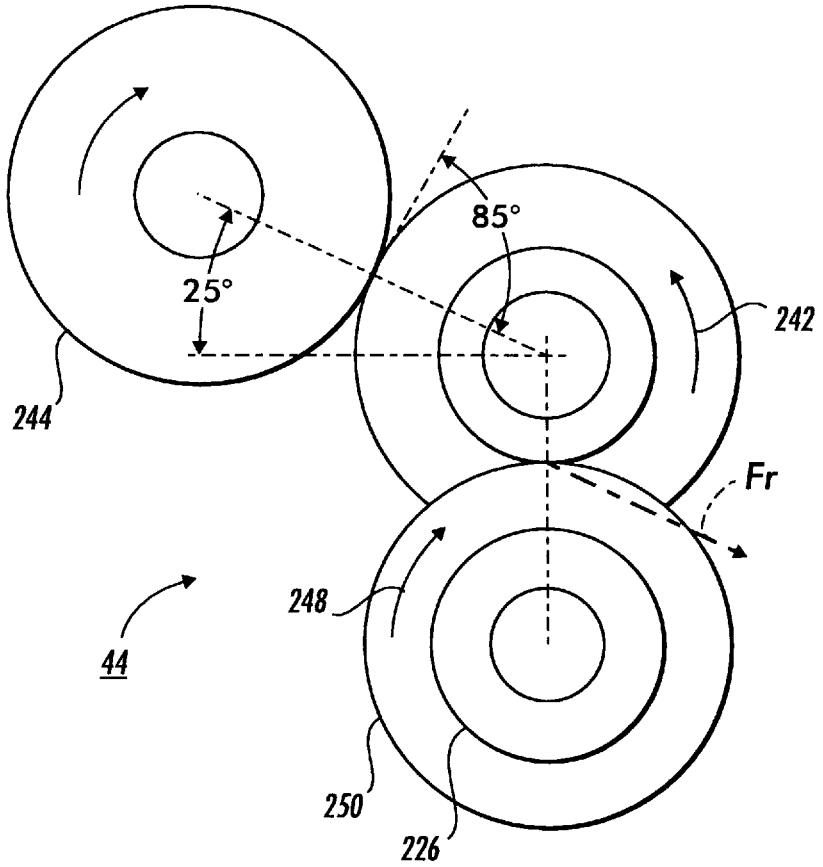
FIG. 8 is a schematic showing the drive gear, photoreceptor gear and developer roll gear, and the attendant reactive force.

Referring now to FIG. 7, the development relationship between the developer roll 92 and the photoreceptor 84, is defined by a jumping toner development gap 220, that is created by spacer caps 222 one of which is shown, that are mounted over the ends of the developer roll 92 to space it precisely from the photoreceptor 84. Any variations in the size of the gap 220 ordinarily results in a poor unacceptable nonuniform toner image density, and hence in poor image quality. As shown, the shaft 224 of the developer roll 92 mounts through the second side 178 of the developer housing 174, and includes a developer gear 250 mounted outside of a wall of the second side 178. The developer roll gear 250 includes a stub shaft 226, that is mounted into the resultant force counter-acting bracket 240 of the present invention. The bracket 240 and the gears are sealed within the process cartridge module 44 by the second side wall 104 of the module housing 100 (FIG. 4).

Typically, drive and photoreceptor gears of a process cartridge are mounted opposite a side of the cartridge to which is mounted a photoreceptor idler gear and the developer roll gear it drives. Ordinarily this requires that flanges to the developer roll gear be glued, and that the photoreceptor be made of a relatively rigid or stiffer and more expensive material in order to be able to withstand a transverse torque on its shaft in transmitting drive from one side to the other thereof. Use of glued gear flanges ordinarily do not allow for easy disassembly and remanufacture of the gear. Failure to use them would likely result in toner contamination of the developer roll gear which normally causes poor gear motion. In accordance with the present invention, however, use of a resultant force counter-acting member in the form of the bracket 240, advantageously allows for the use of non-glued flanges, placement of the gearing of the developer roll on the same side as the drive gear without the undesirable effects of a transverse torque, and thus use of relatively less rigid, and hence less costly materials for the photoreceptor.

Referring now to FIGS. 4, 7, 8 and 9, there is disclosed, the process cartridge drive resultant force counter-acting member, shown as the bracket 240, of the present invention. As shown (FIGS. 7 and 8), when the process cartridge module 44 is fully inserted into the cavity 42 (FIG. 1), a counterclockwise drive motion 242 is imparted via a drive gear 244 from a drive module of the machine 20, to the photoreceptor gear 246. The photoreceptor gear 246, in turn imparts a clockwise drive motion 248 to the developer roll gear 250 as shown. As such, the drive gear 244, idler gears 252 for driving the agitators 186, 188 (FIGS. 4 and 9), and the gears 246, 250 for driving the photoreceptor 84 and developer roll 92, are all located to the same side (i.e. the second side 104) of the process cartridge module 44. As further illustrated, the resultant force Fr (FIG. 8) on the developer roll gear 250 (from the drive gear 244) has a direction that undesirably tends to push the developer roll 92 away from the photoreceptor 84, thereby tending to undesirably increase the jumping development gap 220 (FIG. 7).

Figure 9:
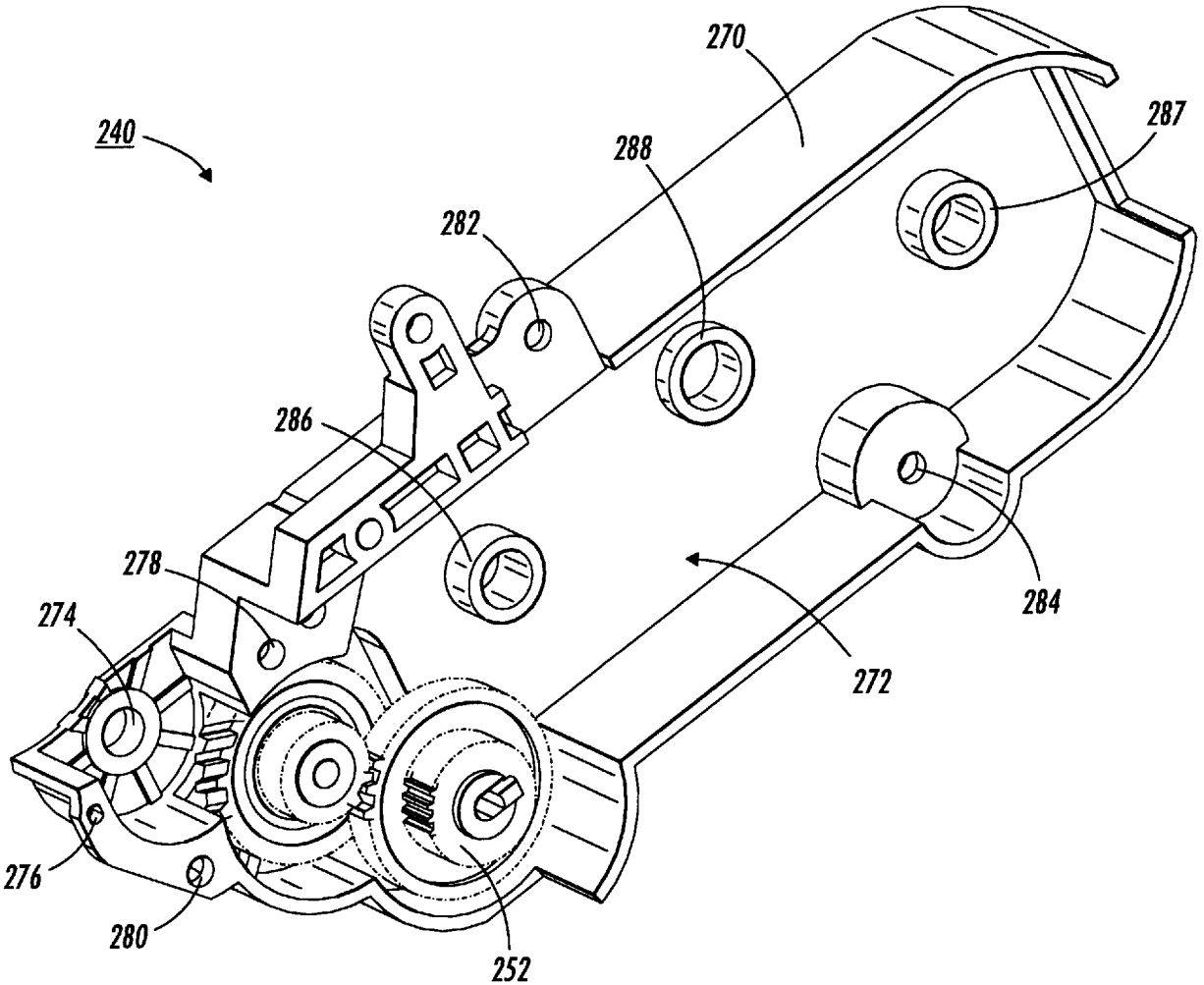
FIG. 9 is a perspective view of the reactive force counter-acting bracket of the process cartridge module of the machine of FIG. 1, in accordance with the present invention.

As further shown in FIG. 9, the bracket 240 comprises an elongate, generally trough-shaped wall 270 made of a plastic material that is relatively stiffer than plastic material used for the developer housing 174 and hence of the wall of the second side 178 thereof, and defining a trough portion 272. Importantly, the wall 270 includes an aperture 274 for receiving and precisely retaining the stub shaft 226 of the developer roll gear 250 in order to prevent it from being moved by the resultant force Fr pushing down on it. The wall 270 also includes a pair of alignment holes 276, 278 for aligning the aperture 274 to the stub shaft 226 of the developer roll gear 250. The wall 270 further includes three distributed force absorbing, screw mounting holes 280, 282, 284 for mounting the bracket 240 to the second side 178 of the developer housing 174 (FIG. 3). As such, the bracket 240 contains and retains the developer roll gear 250 within its trough portion 272, and within the aperture 274, thus preventing it from being moved by the resultant force Fr. The bracket 240 as mounted thus counter-acts the resultant force Fr, and so effectively prevents axial movement of the magnetic roll gear 250, as well as prevents toner-contamination of the magnetic roll gear 250. As further shown, the wall 270 includes within the recess 272, additional retaining apertures 286 for receiving and retaining a stub shaft and drive gear (not shown) of the first agitator 186 (FIG. 3); 287 for receiving and retaining a stub shaft and drive gear (not shown) of the second agitator 188 ((FIG. 3); and 288 for receiving and retaining a stub shaft of an idler gear (not shown) for transmitting drive from the first to the second agitator.

As can be seen, there has been provided an electrostatographic process cartridge detachably mountable into a cavity defined by mated modules forming parts of an electrostatographic reproduction machine. The process cartridge includes an elongate plastic frame having a first side and a second side, as well as an inner surface defining a process chamber. It also includes a rotatable photoreceptive member mounted within the process chamber and to the frame and having an image bearing surface for holding a formed toner image; a rotatable developer member mounted to the frame, forming a critical development gap with the photoreceptive member within the process chamber for enabling jumping toner image development on the image bearing surface; a drive assembly mounted at the second side of the frame for coupling to the photoreceptive member; and a gear train mounted at the second side of the frame, and coupled to the drive assembly and the developer member for transmitting drive to the developer member. The gear-train as mounted including a developer member gear, has a resultant drive force Fr tending to push the developer member gear away from the photoreceptive member, thus tending to widen the critical development gap.

Importantly, the process cartridge includes a resultant force counter-acting member mounted to the second side of the frame for absorbing the drive resultant force Fr. The resultant force counter-acting member includes a wall and a retaining aperture for precisely retaining the developer member in a predetermined aligned position so as to maintain the critical development gap, and thereby ensure uniform quality toner image development.

While the embodiment of the present invention disclosed herein is preferred, it will be appreciated from this teaching that various alternative, modifications, variations or improvements therein may be made by those skilled in the art, which are intended to be encompassed by the following claims:

What is claimed is:

1. An electrostatographic process cartridge detachably mountable into a cavity defined by mated modules forming parts of an electrostatographic reproduction machine, the process cartridge comprising:

(a) an elongate plastic housing having a first side and a second side, and an inner surface defining a process chamber;

(b) a rotatable photoreceptive member mounted within said process chamber and to said housing and having an image bearing surface for holding a formed toner image;

(c) a rotatable developer member mounted to said housing, and forming a critical development gap with said photoreceptive member within said process chamber for enabling jumping toner image development on said image bearing surface;

(d) a drive assembly mounted at said second side of said housing for coupling to said photoreceptive member;

(e) a gear train mounted at said second side of said housing, and coupled to said drive assembly and said developer member for transmitting drive to said developer member, said gear-train as mounted including a developer member gear, and having a resultant drive force pushing said developer member gear away from said photoreceptive member, thus tending to widen said critical development gap; and (f) a resultant force counter-acting member mounted to said second side of said housing for absorbing said drive resultant force, said resultant force counter-acting member including a wall and a retaining aperture for precisely retaining said developer member in a predetermined aligned position so as to maintain said critical development gap, and thereby ensure uniform quality toner image development.

2. The process cartridge of claim 1, wherein said gear train includes a photoreceptive member gear coupled to, and driving said developer member gear.

3. The process cartridge of claim 1, wherein said resultant force counter-acting member is a bracket including three distributed force absorbing screw mounting holes for mounting said bracket to said second side of said housing.

4. The process cartridge of claim 1, wherein said developer member gear includes a stub shaft for insertion and retention within said retaining aperture.

5. The process cartridge of claim 1, wherein said resultant force counter-acting member is made of a plastic material relatively stiffer than plastic material of said plastic housing, for withstanding and absorbing said resultant force without distortion.

6. The process cartridge of claim 4, wherein said resultant force counter-acting member includes a pair of alignment holes for aligning said bracket to said stub shaft of said developer member gear.

7. The process cartridge of claim 5, wherein said resultant force counter-acting member comprises a trough-shaped wall defining a recess for containing said gear train.

* * * * *